US008461491B2

(12) United States Patent
Horsmann et al.

(10) Patent No.: US 8,461,491 B2
(45) Date of Patent: Jun. 11, 2013

(54) SUPPORT FOR AN ELECTRICAL HEATING DEVICE, ELECTRICAL HEATING DEVICE AND MANUFACTURING METHOD

(75) Inventors: Karl-Heinz Horsmann, Bernried (DE); Eugen Wilde, Knittlingen-Freudenstein (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 1259 days.

(21) Appl. No.: 12/261,731

(22) Filed: Oct. 30, 2008

(65) Prior Publication Data

US 2009/0107983 A1 Apr. 30, 2009

(30) Foreign Application Priority Data

Oct. 30, 2007 (DE) ..... 10 2007 053 348

(51) Int. Cl.
*H05B 3/10* (2006.01)
*H05B 3/68* (2006.01)

(52) U.S. Cl.
USPC ..... 219/468.1; 219/520; 219/548

(58) Field of Classification Search
None
See application file for complete search history.

(56) References Cited

U.S. PATENT DOCUMENTS

| | | | | |
|---|---|---|---|---|
| 1,104,572 | A * | 7/1914 | Steward | 219/542 |
| 1,974,360 | A * | 9/1934 | Kimmel | 219/441 |
| 3,612,826 | A | 10/1971 | Deaton | |
| 3,749,883 | A | 7/1973 | Vodvarka et al. | |
| 4,357,523 | A | 11/1982 | Bleckmann | |
| 4,380,116 | A | 4/1983 | Gössler et al. | |
| 4,634,841 | A | 1/1987 | Laughrey | |
| 5,369,874 | A | 12/1994 | McWilliams | |
| 5,844,205 | A * | 12/1998 | White et al. | 219/390 |
| 7,131,725 | B2 | 11/2006 | Walh et al. | |
| 2001/0003335 | A1 | 6/2001 | Griffiths et al. | |
| 2005/0020143 | A1 | 1/2005 | Ross | |
| 2007/0278215 | A1 | 12/2007 | Schilling et al. | |

FOREIGN PATENT DOCUMENTS

| | | |
|---|---|---|
| DE | 520136 | 3/1931 |
| DE | 25 00 586 | 7/1976 |
| DE | 31 31 462 A1 | 2/1983 |
| DE | 37 17 728 A1 | 12/1988 |
| DE | 10 2005 025 896 A1 | 11/2006 |
| GB | 261525 | 11/1926 |
| JP | 2003-115427 | 4/2003 |

OTHER PUBLICATIONS

German Search Report from German Application No. 10 2007 053 349.9.

German Search Report from German Application No. 10 2007 052 348.0.

European Search Report from European Application No. 08017878.3.

* cited by examiner

*Primary Examiner* — Joseph M Pelham
(74) *Attorney, Agent, or Firm* — Alston & Bird LLP

(57) ABSTRACT

An electrical heating device has an integrally manufactured support made from an insulating material. A depressed path is provided for the introduction of a coiled round heating element into the support. In the bottom side of the support, additional depressions are made in support and pass into the depressed path and form undercuts. In the area of the undercuts the heating element is flattened in the path and thereby pressed into the undercuts and consequently can be no longer moved out of said path.

22 Claims, 2 Drawing Sheets

SUPPORT FOR AN ELECTRICAL HEATING DEVICE, ELECTRICAL HEATING DEVICE AND MANUFACTURING METHOD

CROSS REFERENCE TO RELATED APPLICATIONS

This application claims priority to German Application Number 102007053348.0 filed on Oct. 30, 2007, the contents of which are incorporated by reference.

FIELD OF THE INVENTION

The invention relates to a support for an electrical heating device made from insulating material and whose top side carries at least one heating element. The heating element is elongated and runs in top-open paths on the top side of the support. The invention also relates to an electrical heating device having such a support and to a method for the manufacture of such a support and such a heating device.

BACKGROUND OF THE INVENTION

It is for example known from U.S. Pat. No. 5,369,874 to construct an electrical heating device in the form of a radiant heater with a similar support, in which the heating elements in the form of strip heating conductors run in slots in a prefabricated path on the top side of the support. At given intervals the side walls of the paths undergo secondary compression and press laterally against the strip heating conductors in order to mechanically secure the same.

BRIEF DESCRIPTION OF THE DRAWINGS

Embodiments of the invention are described hereinafter relative to the attached diagrammatic drawings, wherein.

DETAILED DESCRIPTION OF THE EMBODIMENTS

Figure 1:
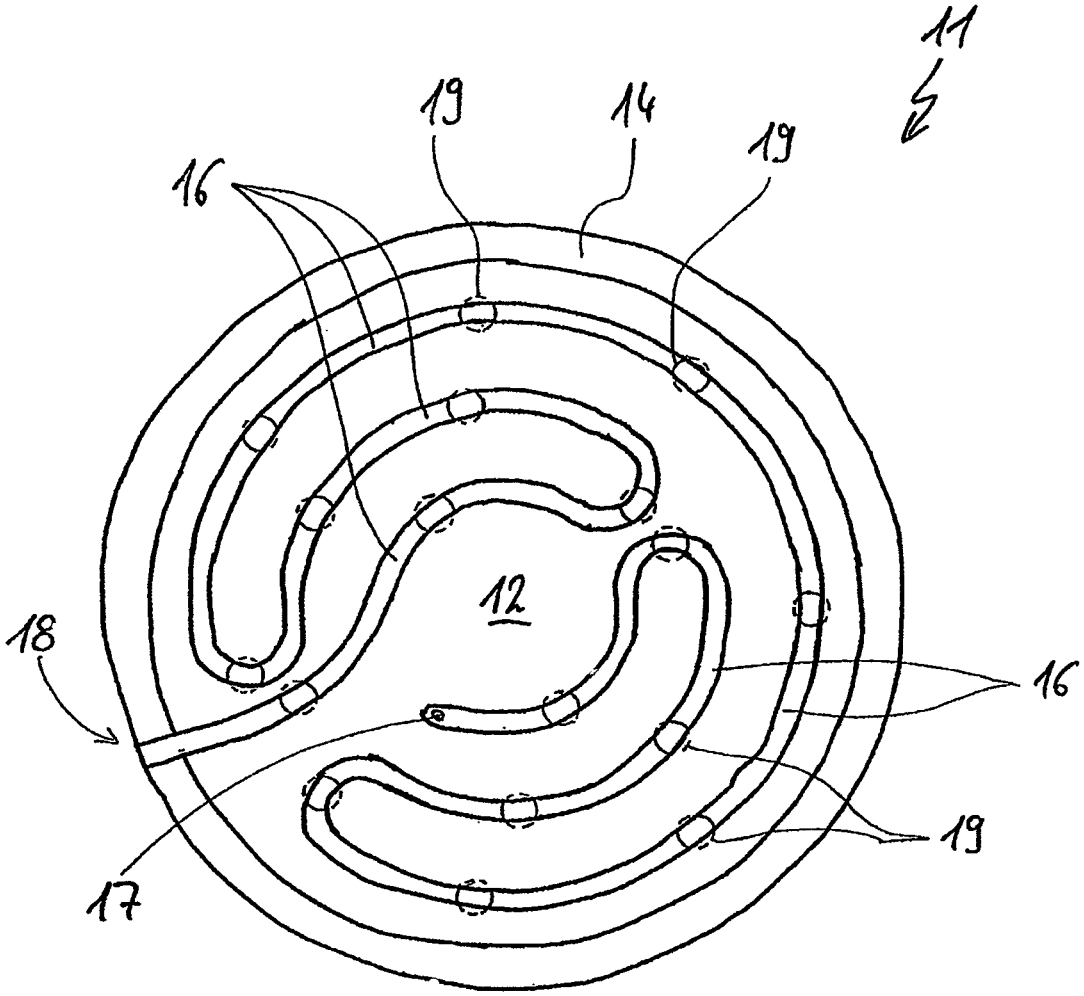
FIG. 1 illustrates a view from above on a support according to one embodiment of the invention without further additional parts.

Various embodiments of the invention include providing an aforementioned support, an electrical heating device with such a support, and a method for its manufacture, which make it possible to obviate the problems and disadvantages of the prior art and enabling in a very simple manner to construct and fit such a heating device.

Advantageous and preferred embodiments of the invention form the subject matter of the further claims and are explained in greater detail hereinafter. Some of the features are only described for one embodiment of the support, heating device or manufacturing method, but independently thereof can also apply to the other embodiments. By express reference the wording of the claims is made into part of the content of the description.

According to one embodiment of the invention, additional depressions are made in the bottom side of the support, which extend at least to the paths, i.e. pass into the latter. These depressions are preferably wider than the paths. Thus, in the vicinity of such depressions openings are created through the support, which are advantageously wider.

Through the application of depressions on the bottom side in the support with a greater width than that of the paths, in some areas of the paths there is a widening in the manner of an undercut. However, because an undercut in the case of a moulding of the support from insulating material cannot take place in a single step and with a moulding direction along a single axis, this is achieved through the depressions. Particularly, if they are wider then undercuts with more space are formed. It is then possible in the depressions for the heating element to be fixed therein by flattening the heating element. This will be explained in greater detail hereinafter. In the vicinity of the depressions, the support is open to the bottom or the heating elements are free towards the bottom. However, this is not necessarily prejudicial and can be eliminated by further coverings or the like or filling the depressions following the flattening of the heating elements.

In one embodiment, the depressions are at least 10% wider than the paths and in one embodiment, much wider than the paths, for example 20% to 60% wider. Thus, adequate space is created or there is an adequately large undercut below the paths.

The depressions can have a round cross-section, and in particular may have a circular cross-section. Alternatively, the depressions can be angular or rectangular. Advantageously, they are constructed in the manner of a blind hole, as will be explained hereinafter, by pressing in a punch or the like during the moulding process.

The distribution of the depressions can fundamentally be chosen in various ways. Advantageously, such depressions are provided at narrow bends or loops of the paths, because it is advantageous here to fix the heating element so as to prevent moving out. A mutual spacing of the depressions can be a multiple of their diameter, for example 3 to 5 or even 20 times. The mutual spacing can also, but need not, be regular.

The depressions can extend up to half the support and advantageously even deeper. With particular advantage the depressions extend 60% to 90% into the support.

The path for the heating elements can extend at least 30% into the support, but advantageously even deeper. The path can for example pass by 40% to 80% into the support, so that a heating element is located below its top side. In conjunction with the above-described depth of the depressions there should be a type of overlap, so that the space formed by the undercut is not located entirely below the path and instead part or even most of it is taken up by the same so as to overlap. This facilitates the flattening of the heating elements in this area, because they then need not be much deeper in order to be able to expand towards the side into the undercut. The path can have a known rectangular cross-section.

The support is advantageously constructed integrally, namely by moulding. In particular it is produced in a single moulding process and it is advantageous to provide depressions on the path for producing the undercuts. Said integral construction does not, however, prevent the fixing of further parts to the support, for example a covering to the underside for electrical insulation or thermal insulation purposes.

Advantageously, according to another embodiment of the invention, in the case of such a support or a heating device on the top side there can be provided a mikanite cover plate, which roughly has the same size as the heating device or at least the surface area covered by the heating elements. Said cover plate can serve for electrical insulation in the upwards direction. If such a heating device is not to function as a radiant heater with high power levels and instead as a "keep-hot" heater with temperatures below 200 C, it has surprisingly been found within the scope of this additional, independent invention that such a cover plate scarcely disturbs or at the most somewhat delays the heat transfer.

In a further embodiment of the invention, the support can be constructed as a flat disk or plate. It can have a circumferential edge or rim projecting over the heating elements or the remaining top side of the support. This can represent an advantageous holding possibility for the aforementioned cover plate. The support as a finished heating device can be pressed with said edge onto the bottom side of a hob plate.

With such a support it is possible to create an inventive electrical heating device, in that the elongated heating elements are placed in the path and run therein. In the vicinity of the depressions the heating elements are flattened or over and beyond the width of the path are pressed into the undercuts created by the depressions. In this way they are secured against lifting upwards, because they are now wider than the path. Said flattening can advantageously take place in that at least from the top side pressure is exerted on the heating element, for example by a stop.

In another embodiment a counterstop is brought up against the heating element from below, so that so-to-speak it is flattened between stop and counterstop. After introduction into the depression, the counterstop remains stationary on the bottom side of the heating element, whereas the stop presses against or even strikes the heating element. A stop for flattening the heating element is advantageously relatively pointed or provided with a narrow edge, so that the heating element can advantageously notch or flatten. The counterstop is advantageously flat and wide in order to give a good support to the heating element.

Such a flattening of the heating element is particularly advantageous if it comprises coiled wire, particularly coiled round heating wire. The narrowness of the coiling is of only minor significance. The cross-section or width of the heating elements can be increased by at least 10% and preferably at least 20% as a result of the flattening action. Thus, it is possible to flatten the coil for securing purposes over and beyond the width of the paths. The normal width of the heating elements is advantageously only slightly less than the width of the paths for easy insertion purposes.

In order to connect the heating elements, it is possible in another embodiment of the invention to pass them from the top side to a bottom side through the support in a central area remote from the outer edge. For this purpose a hole can be provided in the support. The heating elements or their connections or terminals project beyond the bottom side or can be reached there for electrical contacting and mechanical fixing. For this purpose, electrical connecting cables can be brought up to and fixed, for example, by welding them to the terminals. With particular advantage there is a connection of an electrical connecting cable to a terminal of the heating element which is very close to the bottom side of the support. In addition to the electrical connection, this leads to a mechanical securing of the terminals and the heating element to prevent movements.

In another embodiment of the invention, the terminals of the heating elements can be led away laterally from the support. For this purpose the paths can extend up to the outer edge of the support, so that the heating elements or their terminals here can be led to the outside and not project upwards over the top side or the aforementioned edge of the support. The terminals can be, for example, constructed as connecting wires on which is mounted and welded a coiled round heating element. For fixing the same to the support, this can be accomplished by holding means, such as clips or the like, in the outer area of the support and can be, for example, clamped from the top side thereby permitting a simple and mechanically secure connection.

As stated hereinbefore, in a further embodiment of the invention, such a support is advantageously made from a suitable insulating material, preferably a fibre-free, nonceramic insulating material. It is moulded therefrom in a single operation. In a embodiment of the invention, the support can be made relatively thin, for example about 8 mm to 15 mm thick. The thermal insulation is then adequately ensured if the finished heating device does not evolve an excessive temperature. This is particularly the case if the heating device is constructed as a so-called "keep-hot" heater. This means that in the case of food preparation no high energy inputs are present in the heater and instead a hotplate on a hob provided with such a heating device is used for keeping hot saucepans or food. For this purpose the power of the heating element or heating device can be between 100 and 150 Watts, particularly with a power density for the support of 0.6 $W/cm^2$.

Preferably the bottom side of the support is substantially flat. Alternatively, on its bottom side can be provided at least one projecting fixing area, which is preferably integrally shaped, but alternatively it can also be subsequently fixed, for example by bonding. With particular advantage on the bottom side, there are two such fixing areas, which have an identical construction. Such a fixing area projects at least over the bottom side of the support and possibly also over the lateral edge. It is used for fixing the support or the electrical heating device constructed therewith, which can be in the form of a hotplate to a hob below a glass ceramic hob plate. For this purpose, the fixing area has at least one prefabricated opening into which can be screwed a fixing screw or the like. It is also possible to provide several such openings in order to allow a differing positioning with a fine setting of the support. Such an opening is advantageously so directed away from the support so that a fixing screw is approximately perpendicular to the plane of the bottom side of the support.

These and further features can be gathered from the claims, description and drawings and the individual features, in each case singly or in the form of subcombinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

Turning now to the figures, FIG. 1 shows from support 11 as viewed from above. The plate or disk-like support 11 has a top side 12 and a bottom side 13. Around the outside of the top side 12 runs a slightly raised edge 14. The support 11 is manufactured in one piece in a single moulding process, and it normally comprises coiled insulating material, optionally with a binder.

On the top side 12 is formed a path 16, which extends somewhat deeper than half the thickness of the support. For a heating element the path runs in a meander-like manner with a few turns (e.g., "U" turns or reversal turns). The configuration can be such that the path 16 starts and finishes in a central area, where there is at least one hole 17, which at the end of path 16 passes through support 11 to its bottom side 13. Alternatively, the path 16 can run to the edge 14 with an edge exit 18, as is shown in exemplified manner. Here a heating element or its electrical terminal can be led out. On the bottom side of the path 16 is provided round, inventive depressions 19 shown in broken line form. They are provided at reversal points of the path 16 and with a roughly regular spacing between them.

The distribution of the depressions 19 is clearly shown from the bottom view of FIG. 1, where the path 16 is represented in broken line form. It is also possible to see how an opening is provided for at the intersection of the path 16 and depressions 19 passing through the support 11. However, this is not prejudicial in the case of use for a keep-hot heater. Otherwise a further covering could be provided in the downwards direction or the depressions 19 could be subsequently closed.

Figure 3:
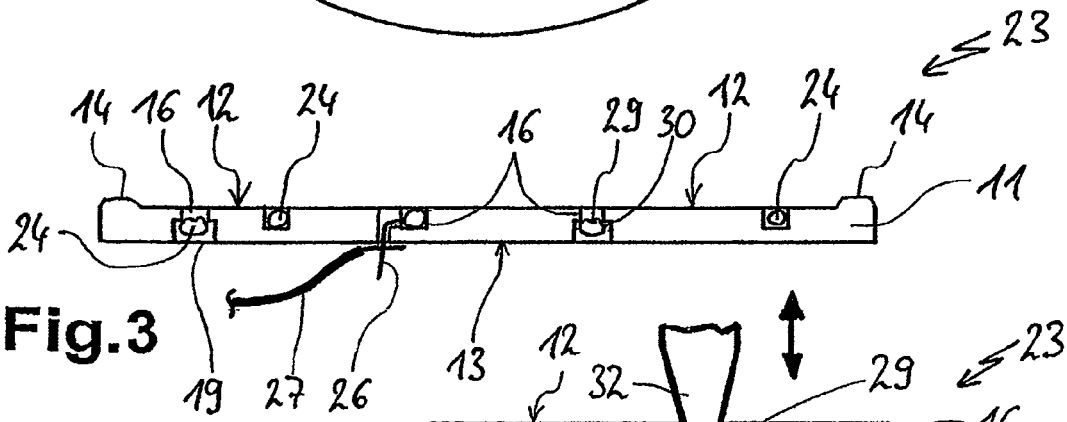
FIG. 3 illustrates a section through a heating device with a support according to FIGS. 1 and 2.

FIG. 3 shows in a lateral section a heating device 23, which is constructed with support 11. In the paths 16 (which are referred to as plural in this instance since a cross-sectional view is provided) run the heating elements 24 comprising coiled heating wire, for example of a FeCrAl alloy. Two depressions 19 are shown and upwardly pass into the paths 16, as is represented in the enlarged views of FIGS. 4 and 5. Otherwise the heating elements 24 run in the paths 16 and are somewhat narrower than the latter and do not project over the top side 12.

It can be seen how at least one terminal 26 passes through the hole 17 in support 11 and projects over the bottom side 13. At the hole 17 a connecting cable 27 is led up and welded to an end of terminal 26 projecting over bottom side 13. Thus, there is not only an electrical contacting, but also a mechanical fixing of terminal 26 to prevent it from moving back and therefore also the heating elements 24 thereon. The same takes place with the other terminal 26.

Figure 4:
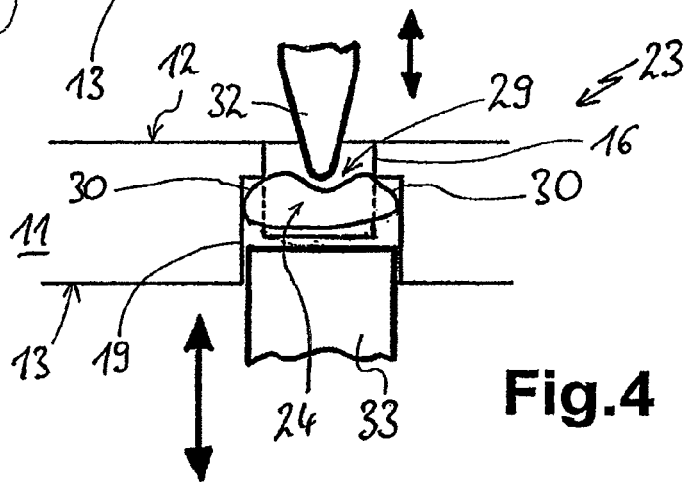
FIG. 4 illustrates an enlargement of a detail of the heating device of FIG. 3 with a flattened heating element.

The larger scale view of FIG. 4 shows the flattening of heating elements 24. For this purpose a counterstop 33 is moved from below into depression 19 and up to heating element 24. From the top side 12 a stop 32 presses or strikes centrally on heating element 24 and distorts it by pressing down on it in said area, so that in the upper area a notch 29 and in particular laterally the widened areas 30 are formed. The widened areas 30 expand almost up to (or contact) the wall of depression 19 and consequently project over path 16, so that the heating element cannot be removed. Stop 32 is no wider than the diameter of depression 19, so that in the longitudinal direction of path 16 here only the heating element 24 is flattened.

FIG. 4 also shows the ratio of the penetration depths of path 16 from top side 12 into support 11 to that of the depressions 19 from the bottom side 13. They overlap in a wide area or the depression 19 creates an undercut of path 16.

Figure 5:
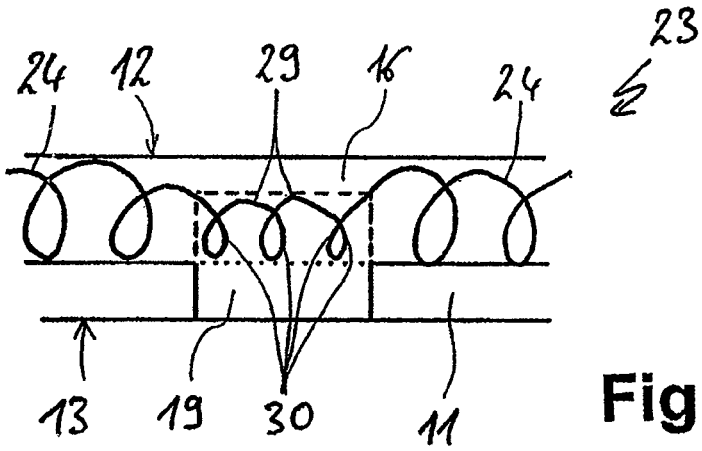
FIG. 5 illustrates the detail of FIG. 4 in side view.
Figure 2:
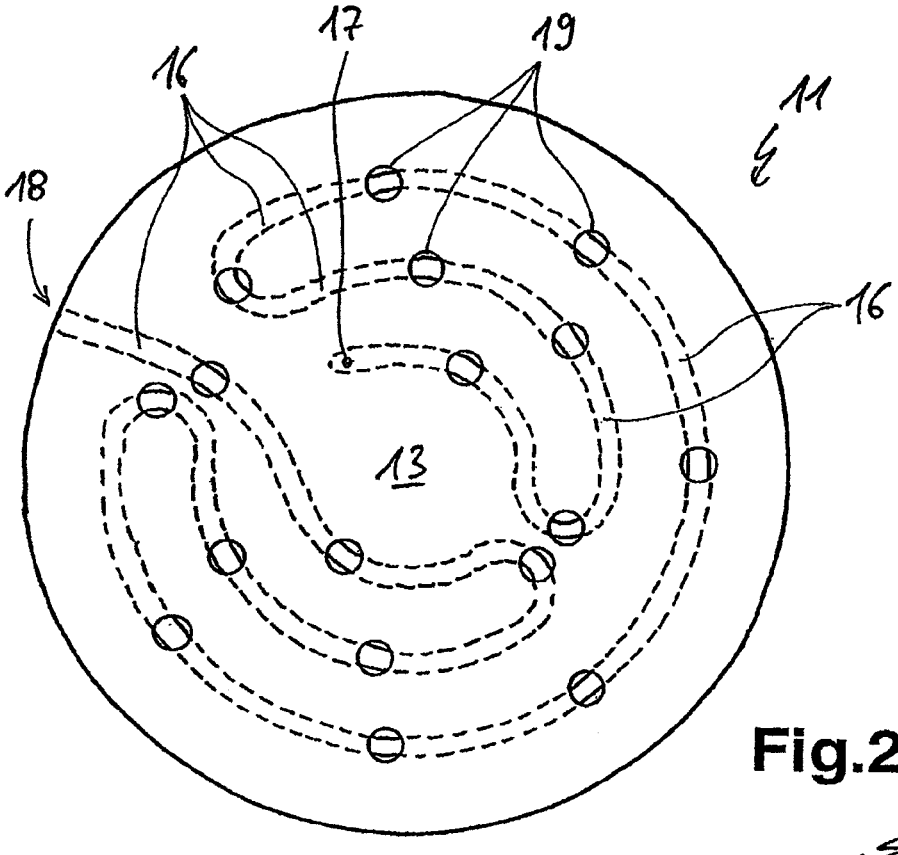
FIG. 2 illustrates a view from below of the support of FIG. 1.

FIG. 5 laterally shows the aforementioned overlap, upwardly to the depression 19 being shown in broken line form and downwardly to path 16 in dotted line form. In the free space which is free from the overlap, the heating element 24 is flattened or has the widened areas 30 holding it in the path 16.

The advantage of the free areas formed by the undercuts with the depressions 19 is mainly that the widening areas 30 of heating element 24 do not have to press into the insulating material of support 11, which leads to damage and therefore structural and most probably undesired changes to the support 11. They can therefore expand without any problem. Otherwise there would be a danger of the support 11 breaking up towards its top side 12, which would in turn prejudice the mechanical fixing.

The invention claimed is:

1. A support with a top side and a bottom side, for an electrical heating device for the placing of heating elements on said top side of said support, said support having depressed paths on said top side, said heating elements being elongated and running in said depressed paths on said top side of said support, said depressed paths being completely open towards said top side, wherein in said bottom side of said support are made additional depressions and said depressions extend at least up to said paths, said depressions being wider than said paths, wherein said depressions have a round cross-section in the manner of a blind hole.

2. Support according to claim 1, wherein said depressions are at least 10% wider than said paths.

3. Support according to claim 1, wherein said depressions have a mutual spacing which is at least 3 to 5 times the diameter thereof.

4. Support according to claim 1, wherein said support is constructed in the manner of a flat disk with a circumferential edge, said edge projecting upwards over said heating elements and also said paths provided for said heating elements, together with side walls of said path.

5. An electrical heating device with a support according to claim 1, wherein said elongated heating elements run in said paths and in vicinity of said depressions over a width of said paths said heating elements are flattened for securing said heating elements against upward lifting.

6. Heating device according to claim 5, wherein said elongated heating elements comprise coiled round heating wire.

7. Heating device according to claim 5, wherein a cross-section or width of said heating elements is increased by at least 10% as a result of said flattening.

8. Heating device according to claim 5, wherein a width of said heating elements in a state prior to said flattening is maximum slightly less than a width of said paths.

9. Heating device according to claim 5, wherein terminals of said heating elements in a central area remote from said outer edge of said top side of said support are passed through to said bottom side through said support and can be reached from said bottom side for electrical contacting or mechanical fixing of said terminals.

10. Heating device according to claim 9, wherein at said bottom side of said support electrical connecting cables are fixed to said terminals for an electrical connection, which fixing brings about a mechanical securing of said terminals and said heating element against moving back.

11. Heating device according to claim 10, wherein a connection of said connecting cables to said electrical terminals takes place very close to said support.

12. Heating device according to claim 5, wherein electrical terminals of said heating elements are led away laterally from said support, said terminals being fixed by holding means close to an outer area of said support.

13. Method for the manufacture of said heating device according to claim 5, wherein said at least one heating element is placed from said top side into said paths and subsequently said heating element is sectorwise flattened or widened at said depressions by pressure thereon at least from said top side.

14. Method according to claim 13, wherein said pressure is also exerted on said heating element from said bottom side by engagement of a counterstop.

15. Method according to claim 14, wherein said pressure takes place from said top side on said heating element through a movement of a stop and from said bottom side said heating element is supported by said counterstop.

16. Method according to claim 15, wherein said stop is pointed or has a narrow edge for notching said profile of heating element, said counterstop being flat and wide and is somewhat smaller than said depression.

17. Method according to claim 13, wherein said connection ends of said heating element are led away laterally from said support through guiding said paths up to said outer edge of said support and so as to project beyond said side of said support.

18. Method according to claim 17, wherein said terminals are fixed by holding means such as clips or the like to an outer area of said support.

19. Method for manufacture of said support according to claim 1, wherein on moulding said support from said insulating material on said top side are formed said depressed paths for said insertion of said elongated heating element and on said bottom side are formed said depressions extending at least up to said paths, said depressions being wider than said paths.

20. A support with a top side and a bottom side, for an electrical heating device for the placing of heating elements on said top side of said support, said support having depressed paths on said top side, said heating elements being elongated and running in said depressed paths on said top side of said support, said depressed paths being completely open towards said top side, wherein in said bottom side of said support are made additional depressions and said depressions extend at least up to said paths, said depressions being wider than said paths, wherein said paths have narrow bends or loops, wherein said depressions are provided on said narrow bends or said loops.

21. A support with a top side and a bottom side, for an electrical heating device for the placing of heating elements on said top side of said support, said support having depressed paths on said top side, said heating elements being elongated and running in said depressed paths on said top side of said support, said depressed paths being completely open towards said top side, wherein in said bottom side of said support are made additional depressions and said depressions extend at least up to said paths, said depressions being wider than said paths, wherein said depth of said depressions is at least 50% of a thickness of said support.

22. Support according to claim 21, wherein said depth of said paths is at least 30% of a thickness of said support.

* * * * *